US010077976B2

(12) United States Patent
Wynn et al.

(10) Patent No.: US 10,077,976 B2
(45) Date of Patent: Sep. 18, 2018

(54) ILLUMINATING ASSEMBLY, PROJECTILE AND PROJECTILE TAIL

(71) Applicant: BRT Medical LLC, Austin, TX (US)

(72) Inventors: Ernest Wynn, Mountain Home, TX (US); Xuechao Zhang, Shenzhen (CN)

(73) Assignee: BRT Medical LLC, Austin, TX (US)

( * ) Notice: Subject to any disclaimer, the term of this patent is extended or adjusted under 35 U.S.C. 154(b) by 0 days.

(21) Appl. No.: 15/718,917

(22) Filed: Sep. 28, 2017

(65) Prior Publication Data

US 2018/0087883 A1 Mar. 29, 2018

Related U.S. Application Data

(60) Provisional application No. 62/462,084, filed on Feb. 22, 2017, provisional application No. 62/400,850, filed on Sep. 28, 2016.

(51) Int. Cl.

| | |
|---|---|
| ***F42B 12/42*** | (2006.01) |
| ***F21L 4/00*** | (2006.01) |
| ***F21V 23/04*** | (2006.01) |
| ***F21V 23/06*** | (2006.01) |
| ***F42B 12/54*** | (2006.01) |
| ***F42B 12/40*** | (2006.01) |
| ***A61D 7/00*** | (2006.01) |
| *F21Y 115/10* | (2016.01) |

(52) U.S. Cl.

CPC ..... *F42B 12/42* (2013.01); *A61D 7/00* (2013.01); *F21L 4/00* (2013.01); *F21V 23/0407* (2013.01); *F21V 23/0485* (2013.01); *F21V 23/06* (2013.01); *F42B 12/40* (2013.01); *F42B 12/54* (2013.01); *F21Y 2115/10* (2016.08)

(58) Field of Classification Search

CPC ..... F42B 12/42; F42B 12/40; F42B 12/52; F21L 4/00; F21V 23/0407; F21V 23/0485; F21V 23/06; F21Y 2115/10; A61D 7/00

USPC ..... 362/157, 96, 101, 110, 154, 171, 194, 362/202, 253, 234

See application file for complete search history.

(56) References Cited

U.S. PATENT DOCUMENTS

| | | | | |
|---|---|---|---|---|
| 4,340,930 | A | 7/1982 | Carissimi | |
| 4,547,837 | A | 10/1985 | Bennett | |
| 4,840,383 | A | 6/1989 | Lombardo | |
| 4,989,881 | A | 2/1991 | Gamble | |
| 5,058,900 | A | 10/1991 | Denen | |
| 5,425,542 | A | 6/1995 | Blackwood et al. | |
| 6,364,499 | B1 | 4/2002 | Jones | |
| 6,390,642 | B1 | 5/2002 | Simonton | |
| 6,533,688 | B1 | 3/2003 | Huang | |
| 6,758,773 | B1 | 7/2004 | Liao et al. | |
| 7,927,240 | B2 | 4/2011 | Lynch | |
| 8,425,932 | B2 | 4/2013 | Weyer et al. | |
| 8,727,918 | B1 * | 5/2014 | Gentile | A01K 15/025 473/570 |
| 8,827,848 | B1 * | 9/2014 | Washburn | A63B 67/18 473/473 |
| 2016/0000061 | A1 | 1/2016 | Boyd | |

FOREIGN PATENT DOCUMENTS

| | | | |
|---|---|---|---|
| WO | 9936744 | A1 | 7/1999 |

* cited by examiner

*Primary Examiner* — Laura Tso

(74) *Attorney, Agent, or Firm* — Bond, Schoeneck & King, PLLC; Joseph Noto

(57) ABSTRACT

The illuminating projectile and projectile tail includes housing, a battery, and a light and lights up upon impact with a target.

17 Claims, 9 Drawing Sheets

ILLUMINATING ASSEMBLY, PROJECTILE AND PROJECTILE TAIL

CROSS REFERENCE

This application claims the benefit of the filing date of U.S. Provisional Patent Application No. 62/400,850, filed Sep. 28, 2016, and U.S. Provisional Patent Application No. 62/462,084, filed Feb. 22, 2017, which are hereby incorporated by reference in their entirety.

FIELD

The present disclosure relates to an illuminating assembly, projectile and projectile tail, and more particularly to an illuminating assembly, projectile and projectile tail which illuminates upon impact.

BACKGROUND

Darts are projectiles that are thrown or shot at targets either recreationally or in veterinary practice. The target can be a moving or stationary object, or the target can be an animal. In sport, darts are used primarily to test and hone a person's accuracy. In veterinary practice, darts are used to deliver drugs, e.g., via Remote Drug Delivery (RDD), scare off unwanted animals, to remove a small amount of tissue from an animal (e.g., for DNA analysis), to acquire a tissue sample for analysis (i.e., a biopsy), to implant a small solid device, such as an electric transmitter or transponder, in an animal, and for other purposes.

In particular, RDD is a popular method for delivering drugs to animals on a global scale. The following are examples of audiences whom use RDD:

- Veterinarian use in delivery of drugs to unapproachable animals (unapproachable meaning feral, wild, aggressive, etc.),
- Capture and relocation of animals in support of animal control needs in urban environments,
- Capture of endangered species for administration of radio tags, etc.,
- Capture of animals on exotic game ranches,
- Delivery of antibiotics and or other drug delivery in the zoo or on exotic ranches as well as domestic cattle, sheep, goats, etc.

Typically, administration is performed by a trained specialist who attempts to locate an animal within a safe darting distance and deliver a dosage of the desired drug via shooting a dart into the soft tissue area of the target animal.

There are many variables that determine the success of drug administration, including the anxiety of the target animal. As an example, an injured whitetail deer will have an elevated level of excitement thereby slowing the administration of a tranquilizer. In this instance, it might take a longer duration of time for the drugs to take effect, thereby allowing the deer to run a long distance and possibly into heavy coverage (e.g., thick woods, brush, etc.). Once this takes place, it can be extremely difficult to recover the tranquilized animal as there is no easy way to find it.

In many cases, the drug administered is an opiate-based drug. Recovery of a dart is crucial and, in the event the dart misses the animal, finding the dart could be difficult. This is especially crucial in urban-related delivery (i.e., removal of stray dogs, cats, etc.).

Darts are also often used to collect biopsies or small samples of tissue for analysis. For example, a small amount of dermis and hypodermis material becomes lodged in the dart tip, and a technician can then remove the dart and assay the tissue for DNA or another desired biometric.

In today's current market, there are base-level darts that have no tracking mechanism and rely on the ability to visually watch the animal until the drugs take effect and the animal can be approached. The obvious limitation of this is that one cannot see the animal when clear land is minimal and/or there is heavy cover. Additionally, in the market exists a very expensive GPS tracker that is attached to the dart but requires both a transponder and a receiver to track the animal/dart. In many applications, this is cost-prohibitive and thereby typically used for a small percentage of overall RDD scenarios.

Typically, lighted nocks for arrows leverage a pre-existing LED/Battery combination called a "bobber light". This is a common product that has been on the market for a number of years originally designed for fishing. The novel aspect related to the lighted nocks is the design of the polycarbonate nock housing surrounding the "bobber light". This housing and related technology is specifically designed for arrows and not necessarily applicable for RDD.

Lighted nocks for arrows are turned on at the "release" of the arrow. This design is based on the desired ability to "watch the arrow" in flight (e.g., like a tracer device). This is counterproductive to darting as the slow travel of the dart, if activated on "release" would be quickly visually identified by the target animal and avoided by moving out of the way of the traveling dart.

The art lacks a RDD device and a dart in general that is activated upon impact and can be visually tracked in a wide range of environments.

SUMMARY

In accordance with one aspect of the present invention, there is provided an illuminating RDD dart, including: a drug delivery substrate and an illuminator tail assembly including a housing having a central bore battery compartment, an adjacent central bore light compartment with an (optionally detachable) stabilizer tail component, and attachment element which attaches the illuminator tail assembly to the drug delivery substrate, a battery having an actuator terminal and being slideably disposed within the battery compartment, and a light having a pair of electrical contacts and being disposed within the light compartment, wherein the illuminator tail illuminates upon impact of the dart with a target.

In accordance with another aspect of the present invention, there is provided an illuminator tail assembly for retrofitting a non-illuminating projectile, the illuminator tail assembly including a housing having a central bore battery compartment and an adjacent central bore light compartment, attachment element for retrofitting a non-illuminating projectile with the illuminator tail assembly, a light having a pair of electrical contacts and being disposed within the light compartment, a battery having a terminal, the battery in electrical contact with one of the pair of electrical contacts and being slideably disposed within the battery compartment, wherein the terminal is capable of contact with the other one of the pair of electrical contacts when slideably actuated, and a tail component (optionally detachable), wherein when retrofit to an RDD substrate the illuminator tail illuminates upon impact with a target.

In accordance with another aspect of the present invention, there is provided an illuminating assembly including a housing having a transparent lighting compartment and an attachment element for retrofitting to a non-illuminating projectile; lighting means visible through the transparent lighting compartment; and actuator means in communication with the lighting means, wherein upon impact the actuator means activates the lighting means.

In accordance with another aspect of the present invention, there is provided an illuminating projectile, including a tissue recovery substrate; an illuminator tail assembly, including a housing having a central bore battery compartment, an adjacent central bore transparent light compartment, a tail component and attachment element; a battery having an actuator terminal and being slideably disposed within the battery compartment; a light having a pair of electrical contacts, disposed within and visible through the transparent light compartment; and an actuator in communication with the light, wherein the substrate is attached to the tail assembly through the attachment element and the illuminator tail assembly illuminates upon impact of the projectile with a target.

In accordance with another aspect of the present invention, there is provided an illuminator tail assembly, including a housing having a central bore battery compartment, an adjacent central bore light compartment, a tail component and attachment element capable of attachment to a projectile; a light having a pair of electrical contacts, disposed within and visible through the transparent light compartment; a battery having an actuator terminal and being slideably disposed within the battery compartment; and an actuator in communication with the light, wherein impact of the assembly with a target causes the battery to slide into an activated position, in which the actuator terminal is in electrical contact with one of the pair of electrical contacts and the battery casing is in electrical contact with the other one of the pair of electrical contacts causing the illuminator tail assembly to illuminate upon impact with a target.

These and other aspects of the present disclosure will become apparent upon a review of the following detailed description and the claims appended thereto.

DETAILED DESCRIPTION

Figure 1:
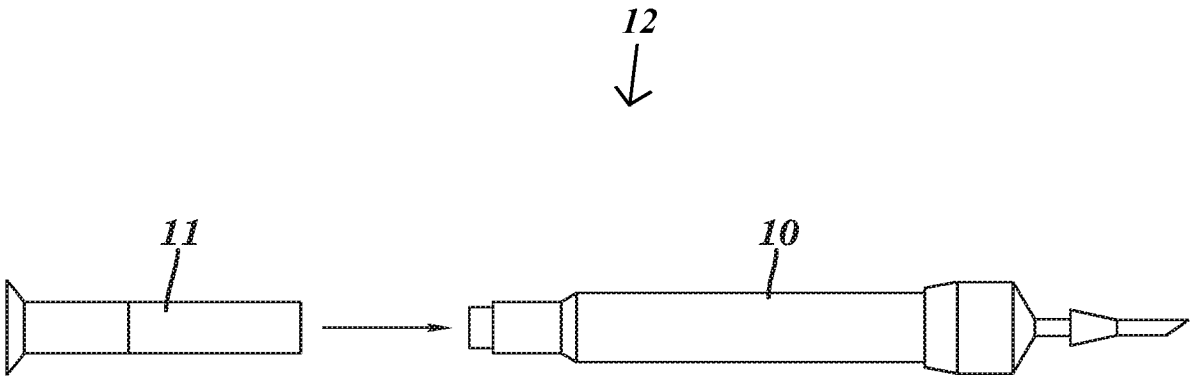
FIG. 1 is a telescoping view of an illuminating RDD dart having an optionally detachable illuminating tail assembly in accordance with an embodiment of the present disclosure.

The present disclosure relates to a projectile such as an illuminating dart. The present disclosure further relates to an illuminator dart tail, for use with, for example a RDD dart. One embodiment of the illuminating dart tail is designed to be retrofit to a RDD polycarbonate tube dart, although this design may be expanded to be adaptable to other projectiles.

The illuminated dart tail provides the user with significant benefits, such as visual location of the deployed dart upon impact, visual location of a darted animal in areas with heavy coverage; and the ability to dart during dawn, dusk, and even nighttime when low sunlight limits the ability to locate darts and darted animals. In one embodiment, the dart tail emits a flashing, color changing LED light that can be seen from a distance.

Typically, darting of animals close to dusk is not advisable as once dark, the animal is difficult to identify and recover. The advantage of darting near dusk is that it is typically cooler, which is important to the health of the target animal being tranquilized because the body temperature rises when the tranquilizer is administered; if the animal is darted in a hot environment the animal could be at risk of overheating. By darting close to dusk, the probability of recovery with the illuminated dart is significantly improved compared to traditional darting methodologies.

Another embodiment of an illuminating dart is an illuminating dart for collecting biopsies or small amounts of tissue for DNA or other types of analysis. The dart is designed to simply fall out of the animal and there is no barb or barb-type of fixture on the outside of the needle (smooth shaft needle). In an embodiment, the dart includes a farrel "cutter" on the outside protecting three barbs on the inside of the cylinder. Upon hitting the target animal, tissue enters the farrel and can be removed by a technician.

An embodiment of an illuminating remote drug delivery dart includes a drug delivery substrate and an optionally detachable illuminator tail assembly. The drug delivery substrate for the remote drug delivery dart, is designed for injecting a liquid medication (can be tranquilizing agent or other medication, such as antibiotic). The dart in an embodiment is composed of a cylindrical chamber with a tapered forward end provided with a pointed hollow needle. A conical valve bears against an annular seat in the chamber and leverages a triggering system and a plunger behind the chamber which can be activated with compressed air, combustion from a small powder charger or electronically. Upon impact, the trigger activates the release of the plunger forward causing the liquid medication to disburse from the needle into the animal.

An embodiment of an illuminator tail assembly includes a housing, battery, light, an actuator and tail component (optionally, stabilizer tail). The illuminator tail assembly can be attachable to the substrate of a non-illuminating dart and can be retrofitted by replacing the original tail with the illuminator tail. Alternately, a dart can be fabricated that includes the body of the dart and the illuminator tail. For example, a dart can be manufactured containing a drug delivery substrate and an illuminator tail.

The housing can be any projectile compatible shape, such as, for example, a cylinder or shaft. The housing can include a central bore battery compartment and an adjacent central bore light compartment. The housing around the light compartment can be made of a transparent, translucent, or other light transmitting material; the housing around the battery can be made of the same material as that around the tail or another material. The housing around the light compartment and the battery compartment can be one or more pieces. An embodiment includes a taper design of the tail housing. In an embodiment, the housing includes an attachment element that allows the illuminating dart tail to be securely attached to the body of the dart, and the dart could be either manufactured originally as a non-illuminating dart or newly with the illuminating tail. The attachment element can be threaded so that the tail is screwed on, include elements so that the tail and body can be pushed together, include clips or other types of hardware, or other configurations that allow a secure attachment of the tail to the dart body, such as by gluing.

The battery contains stored chemical energy that, upon activation, is converted into electricity and used as a source of power. In one embodiment, the battery has an actuator terminal and can slide within the battery compartment. The battery casing can be metal or another electrically conductive material, whereby the housing can be the negative source with a positive terminal extending from one end, or the opposite configuration. The battery can be of nominal capacity, for example: 25 mAh, nominal voltage: 3.0 v, maximal constant current: 3 mAh, and peak pulse current 15 mA. A suitable working temperature is approximately 40-85° C. and suitable storage temperature is approximately 10-30° C.

The light can be a light-emitting diode (LED), fluorescent light, halogen light, incandescent light, or anything that produces light. In one embodiment, an LED light has a pair of electrical contacts, e.g., a negative lead (electrode and a positive lead) and is disposed within a light compartment within the housing. When activated, the negative lead and positive lead of the light makes electrical contact with the positive terminal end of the battery and the negative casing of the battery to complete the circuit. The light color can be any color, combination of colors, or series of colors. In one embodiment, the light cycles between red, green, and blue and contains a small circuit to induce a fast/slow strobe effect and a color change effect.

The actuator includes means for "turning on" the light when the dart impacts the target. The activator can include electronic activation, chemical activation, or mechanical activation. In one embodiment that includes mechanical activation, as illustrated in FIG. 4, the battery compartment is in back and the light compartment is in front relative to the direction of travel of the dart. This design enables the use of one or more of the following: the relative weight of the battery, the battery circumference, the degree of housing taper, the friction of the battery casing material on the housing material, the friction of the battery casing material on the slide contact, and the force of impact with the target, to slide the battery quickly and forcefully towards the light upon impact with the target, thus joining the battery and the electrical contacts of the light and completing the circuit and maintaining the completed circuit after impact, while also preventing actuation prior to and during firing and prior to impact of the dart. Another mechanical activation could leverage a spring-activated trigger that releases on impact. Although this design leverages the sliding battery activation method upon target impact, additional methods of activation are possible. For example, electronic activation could leverage a load sensor that, upon impact, activates the light. A chemical activation method could leverage the mixing of two reactive agents that result in an illuminating reaction. Akin to glow sticks, the light compartment of the dart could include two sub-compartments—one containing a fluorescent dye (e.g., diphenyl oxalate and one containing hydrogen peroxide. The barrier between these compartments is relatively fragile (e.g., glass) and, when the dart hits the target, the barrier is broken and the contents of the two compartments mix. The mixing of the contents initiates an exothermic reaction creating a chemical illumination. Other methods of activating the illumination of the light upon impact are possible, and these examples are not meant to limit the realm of the disclosure.

The illuminating tail can optionally include a stabilizer tail or a smooth tail. The stabilizer tail component can be polypropylene material and pantone 1645C in color. The purpose is to stabilize the dart in flight, reduce dart drift and wobble, and improve accuracy.

The dart can be of a reusable or disposable design and is activated (turned on upon impact. Upon impact, the force of impact drives the battery forward into the tapered end of the housing, thereby completing the circuit and activating the light. The force of impact is great enough to drive the battery tightly into the taper such that the reversal of battery movement would take a force substantially greater than normal course of activity would allow and thereby preventing loss of connection/deactivating the light. In another embodiment, there is a means of holding the battery in position upon activation, thereby preventing premature deactivation. In the case of one embodiment of an RDD dart with illuminating tail, the activation is designed to operate at or below the ranges of force that discharge the drug delivery upon impact. For example, a 40 g dart traveling an average of 100 feet per second (fps), has sufficient impact force to discharge the drug payload. The desired impact for the dart discharge is sufficient to activate the light. The activation is designed to prevent activation by the relatively smaller forces of acceleration when the dart is being handled before use and also when the dart is initially shot at the target, but the illuminating tail should be activated upon impact with the target. In an embodiment with a slide-activation mechanism, the battery would not complete the circuit/make contact with the LED light during assembly, shipping, or general handling.

The dart can be thrown by hand or shot by a blowgun, dart gun, dart projector, or the like.

In an embodiment, an original equipment manufacturer (OEM) dart can be retrofitted with the illuminator tail such that the illuminator tail illuminates upon impact with a target. Operation of the illuminator tail involves first, removal of the existing OEM tail on the dart, and replacing it with the illuminator dart tail. This can be done by pulling off the existing stabilizer tail by hand and installing the illuminator tail by pressing the attachment element on by hand. Once the illuminator dart tail is installed on the dart, the desired drug is inserted into the dart when the dart is an RDD. The dart is then loaded into the Dart Projector, for example, a cartridge fired dart gun. The target animal is then shot into the prescribed soft-tissue area and, upon impact of the dart, the battery slides forward and becomes jammed into the tapered end of the illuminator dart tail housing thereby completing the positive/negative connection and turning on the LED component.

Another embodiment of the illuminated dart tail is compatible with darts designed to inject drugs via the capture of spent gas through the barrel of the projector, e.g., dart gun, into the dart via a one-way valve. This version of the illuminated dart tail accommodates the flow and directing of spent gas (compressed air, charge gas, carbon dioxide, etc.)

through small vents surrounding the lower portion of the dart tail housing. The spent gas then enters into an air chamber within the RDD dart thereby "charging" the dart while being shot through the projector/dart gun for discharge of the drug upon impact.

Operation of this embodiment of the illuminator tail involves insertion of the illuminator tail onto the RDD gas capture vent. This may be done by placing a single drop of permanent glue onto the inside of the vented end of the illuminator tail and pressing the illuminator tail on by hand. Once the illuminator dart tail is installed on the RDD, the desired drug is inserted into the RDD. The RDD is then loaded into the dart projector (e.g., a cartridge-fired dart gun).

FIG. 1 shows an example of an illuminator dart 12, in which there is a detachable illuminator tail assembly 11 that attaches to a dart substrate 10 prior to use.

Figure 2:
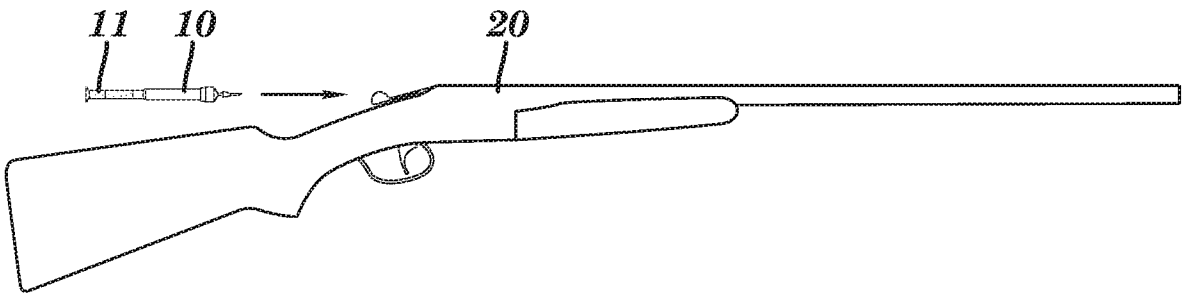
FIG. 2 is a diagram of an illuminating RDD dart being put into a dart gun in accordance with an embodiment of the present disclosure.

FIG. 2 is a diagram of the dart substrate 10 having an illuminator tail assembly 11 being put into a dart gun 20.

Figure 3:
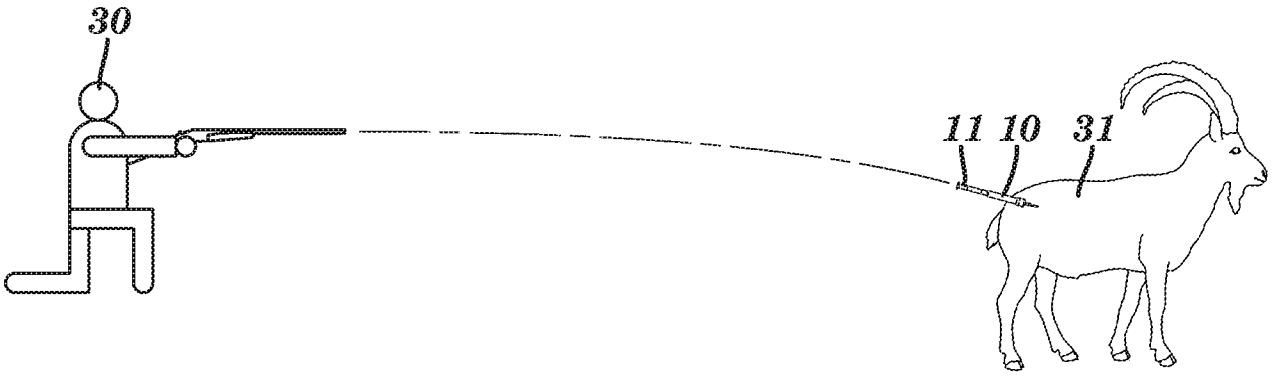
FIG. 3 is a diagram of an illuminating RDD dart being shot at a target animal in accordance with an embodiment of the present disclosure.

FIG. 3 shows a dart substrate 10 with an illuminator tail assembly 11 that was shot by a chemical immobilization specialist 30 and hit the target animal 31. The illuminator tail assembly 11 illuminates upon impact.

Figure 4A:
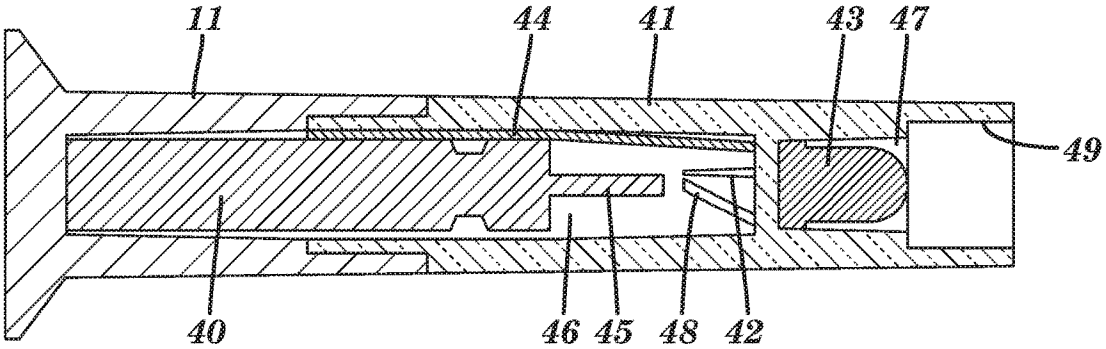
FIG. 4A is a cross-sectional view of an illuminator tail in an "off" position and FIG. 4B is a cross-sectional view of an illuminator tail in an "on" position in accordance with an embodiment of the present disclosure.
Figure 4B:
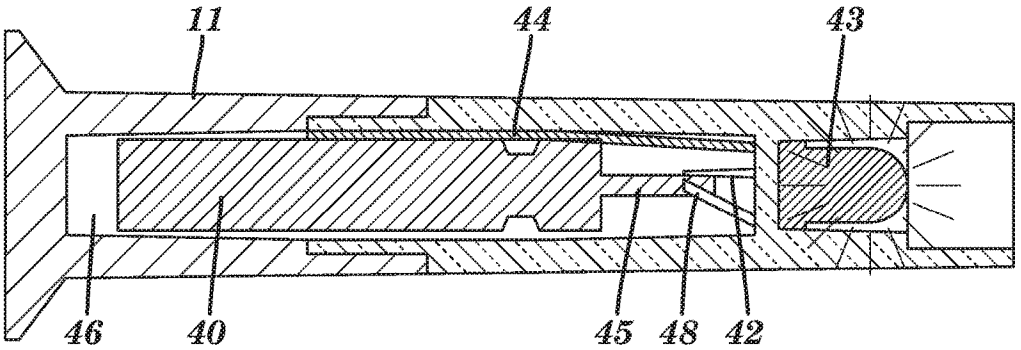

FIG. 4 shows an embodiment of how a disposed battery moves within the housing to activate the light upon impact. FIG. 4A depicts a cross-section of the illuminator tail assembly 11 before the dart is shot. The tail assembly includes housing 41 that is transparent at least around the light, a battery 40, and an LED light 43. The battery 40 resides in the back of the housing 41 and in the back of the battery compartment 46 of the illuminator tail assembly 11. There is space between the positive terminal 45 of the battery 40 and the actuator 42, as well as the positive terminal 45 of the battery 40 and the positive electrode 48 of the LED light 43, and thus the LED light 43 is not illuminated. The LED light 43 sits within the LED compartment 47, and a negative LED electrode 44 and a positive LED electrode 48 extend from the LED compartment 47 to the battery compartment 46. In this figure, the negative LED electrode 44 contacts the negative housing of the battery 40 before the dart is shot. In an embodiment, the outer casing of the battery (negative terminal), positive terminal of the battery, positive and negative electrodes of the LED light and actuator form an activating mechanism. The housing also includes an attachment element 49 that allows a secure attachment of the illuminator tail assembly to the dart body. Upon impact of the dart with the target animal, the illuminator tail assembly 11 assumes the configuration shown in FIG. 4B; the battery 40 is lodged forwards and the positive terminal 45 of the battery 40 is guided by the actuator 42 to contact the positive electrode 48 of the LED light 43, thereby illuminating the LED light 43. The friction between the battery 40 and the battery compartment 46 jam the battery in place and keep the circuit closed, thereby keeping the LED light 43 illuminated.

Figure 5:
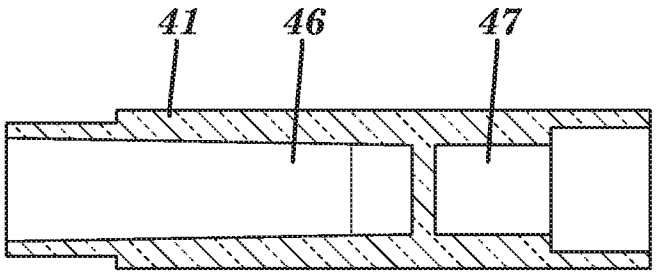
FIG. 5 is a cross-sectional view of a taper design of a tail housing in accordance with an embodiment of the present disclosure.

FIG. 5 shows the tapered design of the battery compartment. In a cross-sectional view of the housing 41, one can see that the battery compartment 46 is tapered within the housing 41—the diameter of the compartment close to the LED (the front of the compartment is smaller than the diameter towards the back of the dart. Thus, the battery fits comfortably in the back of the compartment before the shot and does not complete the circuit/make contact with the LED light during assembly and general handling. The force of the shot slides the battery into the front of the battery compartment 46 where it gets stuck, thus activating the circuit until it is manually deactivated.

Figure 6:
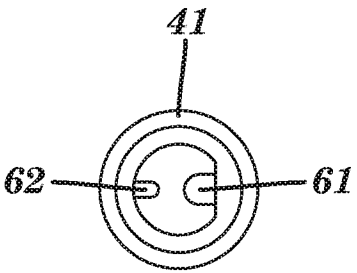
FIG. 6 is a cross-sectional end view of a section of the LED light holder in the housing in between the LED compartment and the battery compartment in accordance with an embodiment of the present disclosure.

FIG. 6 shows a cross-sectional view of the housing 41 in between the battery compartment 46 and the LED compartment 47. There are two holes 61 and 62, through which the negative LED electrode and the positive LED electrode are guided, thus securing the LED in place.

Figure 7:
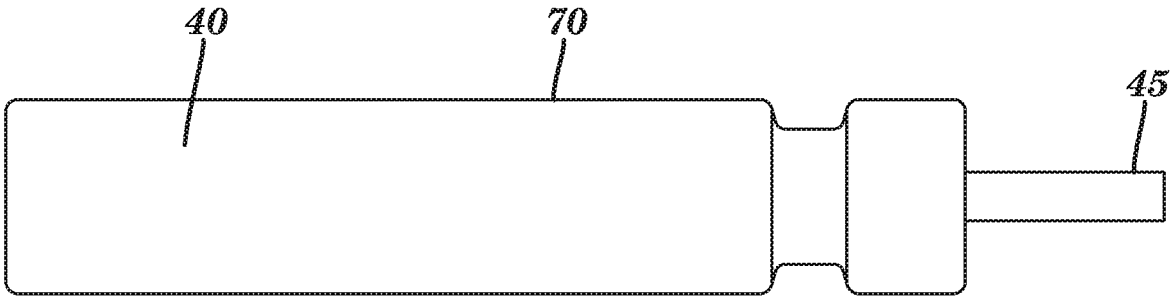
FIG. 7 is a side view of a battery in accordance with an embodiment of the present disclosure.

FIG. 7 shows a side view of an embodiment of a battery 40 with several of its features. The battery includes a negative terminal housing 70 on the back and a positive terminal 45 on the front.

Figure 8:
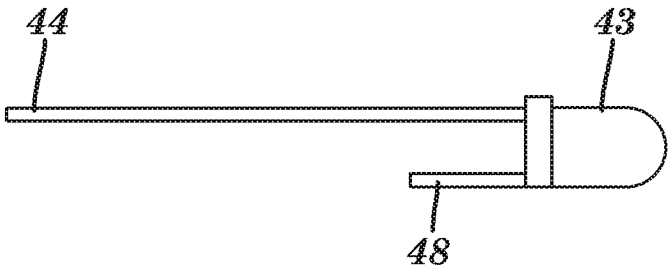
FIG. 8 is a side view of an LED light bulb in accordance with an embodiment of the present disclosure.

FIG. 8 shows a side view of an LED light bulb with several features. The LED light 43 includes a positive electrode 48 and a negative electrode 44. In the example depicted in FIGS. 4-8, the negative electrode 44 of the LED light 43 remains in contact with the negative terminal housing 70 of the battery 40 at all times. When the dart penetrates the target animal, the battery slides into the front of the compartment and the positive electrode of the LED contacts the positive pin of the battery, thus completing the circuit and illuminating the LED.

Figure 9:
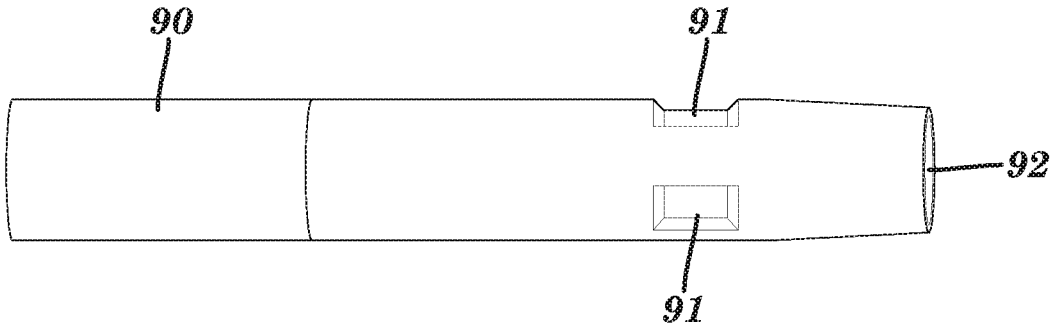
FIG. 9 is a side view of dart housing in accordance with an embodiment of the present disclosure that includes vents and an opening to direct gas.

FIG. 9 illustrates an illuminator tail assembly for use with an air injector RDD with a smooth cap 90, vents 91 for capture of gas, and an opening 92 for captured gas charge. In this example, the dart tail directs the flow of spent gas (e.g., compressed air, charge gas, carbon dioxide through the vents 91 and subsequently through the opening 92 into the lower part of the housing (not shown). The gas then enters an air chamber within the RDD/dart thereby "charging" the dart while the dart is shot through the projector (i.e., dart gun for more forceful discharge of the drug upon impact.

Figure 10:
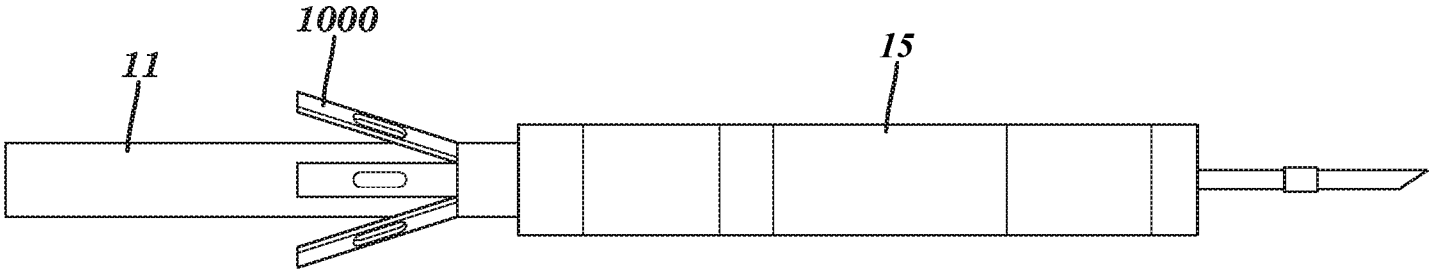
FIG. 10 is a side view of a dart and a smooth illuminating tail in accordance with an embodiment of the present disclosure.

FIG. 10 depicts an example of an RDD 15 with stabilizer 1000 attached to an illuminator tail assembly 11. The tail is smooth, and the dart's stabilizers 1000 are positioned on the dart body and not on the illuminating tail.

Although various embodiments have been depicted and described in detail herein, it will be apparent to those skilled in the relevant art that various modifications, additions, substitutions, and the like can be made without departing from the spirit of the disclosure and these are therefore considered to be within the scope of the disclosure as defined in the claims which follow.

What is claimed:

1. An illuminating projectile, comprising:

a dart substrate;

an illuminator tail assembly, comprising a housing comprising a central bore battery compartment, an adjacent central bore transparent light compartment, a tail component and attachment element;

a battery having an actuator terminal and being slideably disposed within the battery compartment;

a light disposed within and visible through the transparent light compartment, the light having a pair of electrical contacts; and an actuator in communication with the light, wherein the dart substrate is attached to the tail assembly through the attachment element and the illuminator tail assembly illuminates upon impact of the projectile with a target.

2. The device of claim 1, wherein the projectile is a remote drug delivery dart.

3. The device of claim 1, wherein the substrate comprises a drug delivery substrate.

4. The device of claim 1, wherein the substrate comprises a tissue collection substrate.

5. The device of claim 1, wherein the light compartment is disposed forward of the battery compartment relative to a direction of travel of the projectile.

6. The device of claim 1, wherein the light is an LED.

7. The device of claim 6, wherein the LED is a flashing, color changing LED.

8. The device of claim 1, wherein the tail component is detachable from the illuminator tail assembly.

9. The device of claim 1, wherein activation of the illuminator tail assembly is prevented during acceleration upon shooting the projectile.

10. The device of claim 1, wherein the tail component is a stabilizer tail or a smooth tail.

11. An illuminator tail assembly, comprising:

a housing comprising a central bore battery compartment, an adjacent central bore light compartment, a tail component and attachment element capable of attachment to a projectile;

a light disposed within and visible through the transparent light compartment, the light having a pair of electrical contacts;

a battery having an actuator terminal and being slideably disposed within the battery compartment; and an actuator in communication with the light, wherein impact of the assembly with a target causes the battery to slide into an activated position, in which the actuator terminal is in electrical contact with one of the pair of electrical contacts and the battery casing is in electrical contact with the other one of the pair of electrical contacts causing the illuminator tail assembly to illuminate upon impact with a target.

12. The device of claim 11, wherein the light compartment is disposed forward of the battery compartment relative to a direction of travel.

13. The device of claim 11, wherein the light is an LED.

14. The device of claim 13, wherein the LED is a flashing, color changing LED.

15. The device of claim 11, wherein the tail component is detachable from the illuminator tail assembly.

16. The device of claim 11, wherein the activation of the illuminator tail assembly is prevented during acceleration upon shooting the projectile.

17. An illuminating projectile, comprising:

an illuminating assembly including a housing having a transparent lighting compartment and an attachment element capable of attaching the assembly to a non-illuminating dart; lighting means visible through the transparent lighting compartment; and actuator means in communication with the lighting means, wherein upon impact the actuator means activates the lighting means.

* * * * *